United States Patent [19]

Kirby et al.

[11] 4,189,374

[45] Feb. 19, 1980

[54] COAL LIQUEFACTION PROCESS EMPLOYING INTERNAL HEAT TRANSFER

[75] Inventors: Lawrence J. Kirby; Thomas E. Richardson, both of Littleton; Bruce K. Schmid, Denver; John V. Ward, Arvada, all of Colo.

[73] Assignee: Gulf Oil Corporation, Pittsburgh, Pa.

[21] Appl. No.: 969,160

[22] Filed: Dec. 13, 1978

[51] Int. Cl.[2] ..... C10G 1/04

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 4,028,219 | 6/1977 | Baldwin et al. | 208/8 LE |
| 4,121,995 | 10/1978 | Hsu | 208/8 LE |

*Primary Examiner*—Herbert Levine

[57] ABSTRACT

A coal liquefaction process wherein a feed coal-solvent slurry is preheated in a thoroughly back-mixed preheater zone and then passed to a dissolver zone. Hot hydrogen is introduced to the process downstream from the preheater zone at or in advance of the dissolver zone and exothermic hydrocracking reactions occur in the dissolver zone. A dissolver zone effluent stream is passed through a vapor-liquid separator and separated hot dissolver vapor at process pressure is vented through the preheater zone wherein it is quenched to provide direct transfer to the preheater zone of the exothermic heat generated in the dissolver zone. The preheater zone is continuously vented to provide rapid removal of cooled vapor from the preheater zone and from the process, advantageously leaving an accumulation of liquid in the preheater zone boiling between the temperatures of the vapor-liquid separator and the preheater zone at process pressure. Venting of hot vapor generated in the exothermic dissolver zone through the preheater zone to accomplish direct internal heat exchange within the process requires continuous venting of cooled vapor from the preheater zone independently of removal of slurry from the preheater zone. Such independent venting of the preheating zone is feasible because of the introduction of hydrogen to the process downstream from the preheating zone.

5 Claims, 1 Drawing Figure

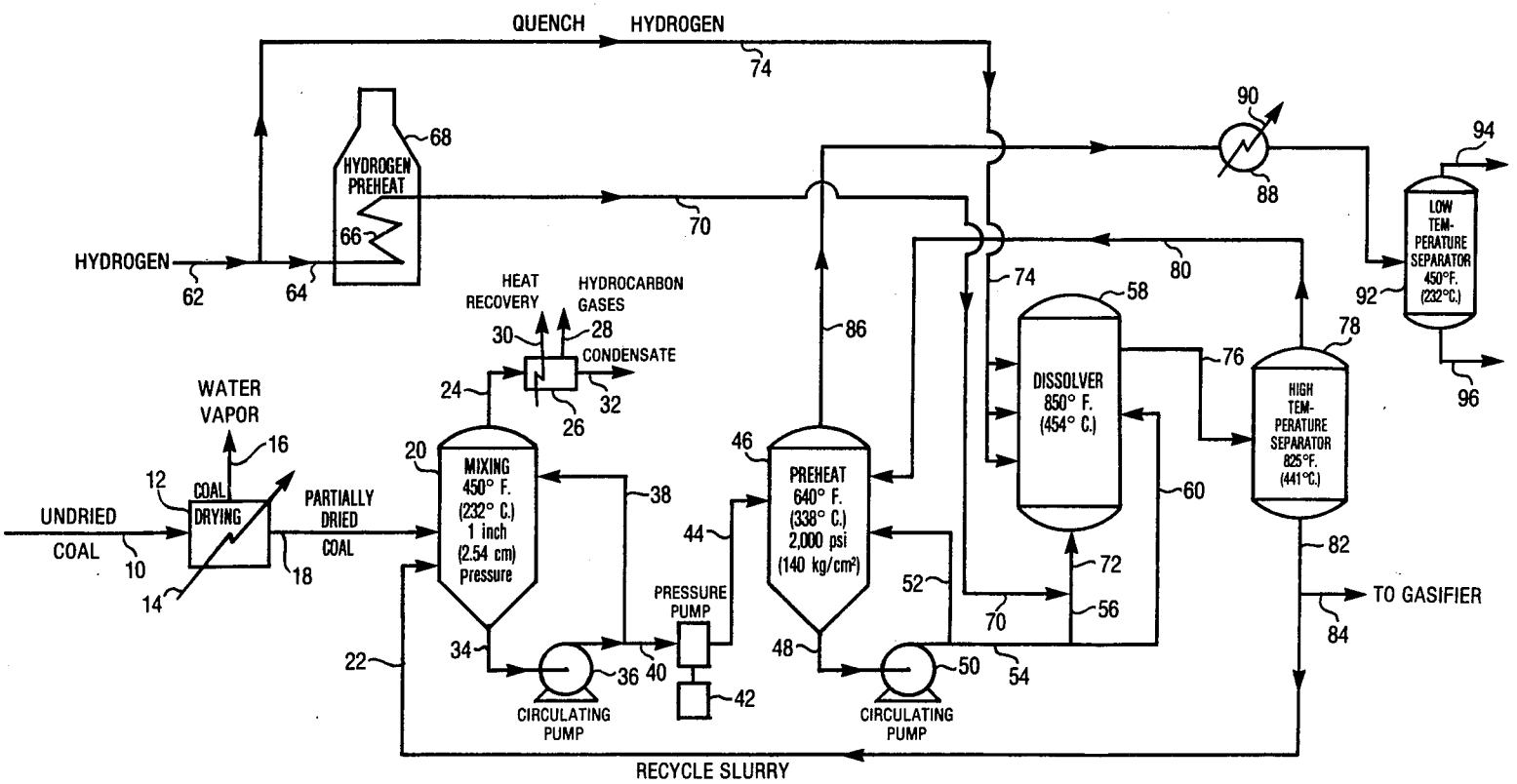
LOW TEMPERATURE SEPARATOR 450°F. (232°C.)
HIGH TEMPERATURE SEPARATOR 825°F. (441°C.)
TO GASIFIER
DISSOLVER 850° F. (454° C.)
PREHEAT 640° F. (338° C.) 2,000 psi (140 kg/cm²)
CIRCULATING PUMP
PRESSURE PUMP
RECYCLE SLURRY
MIXING 450° F. (232° C.) 1 inch (2.54 cm) Pressure
HYDROCARBON GASES
CONDENSATE
HEAT RECOVERY
HYDROGEN PREHEAT
QUENCH
HYDROGEN
WATER VAPOR
COAL DRYING
PARTIALLY DRIED COAL
UNDRIED COAL

COAL LIQUEFACTION PROCESS EMPLOYING INTERNAL HEAT TRANSFER

The present invention relates to a process for the solvent liquefaction of coal.

In the present process, wet, crushed feed coal is partially dried in a thermal predrying zone. Partially dried coal is then slurried with a hot recycle hydrogen donor solvent-containing slurry stream at a pressure below process pressure in a vented feed coal mixing vessel. The heat in the hot recycle stream raises the temperature in the mixing vessel to a level sufficiently high to vaporize essentially all of the water remaining in the feed coal. Water vapor is vented from the drying zone independently of the removal of drying zone effluent slurry to rapidly release from the process water vapor formed in the drying zone.

For the purpose of process heat economy it would be desirable to permit the temperature in the feed coal mixing vessel to reach the maximum level attainable from the heat contained in the hot recycle slurry stream. However, the maximum operable temperature in the feed coal mixing vessel is limited because of the formation of a gel upon admixture of the feed coal with the hot recycle slurry stream. The rate of gel formation increases as the temperature in the feed coal mixing vessel increases. In the present process, the temperature in the feed coal mixing vessel is sufficiently high so that if sufficient time elapses a peak viscosity would be reached rendering the mixture too thick to pump. However, by holding the residence time to a sufficiently low level the peak viscosity is not reached and the mixing vessel slurry is pumped into a preheater zone before the viscosity of the gel exceeds the limits of pumpability. In this manner, a high degree of direct heat transfer is achieved without incurring the concomitant detriment of a peak gel viscosity. To achieve this, the temperature of the slurry in the mixing vessel should be in the range 300° to 500° F. (149° to 260° C.) and the slurry residence time in the mixing vessel should be 5 to 30 minutes, with relatively low residence times being utilized with relatively high temperatures.

The temperature in the feed coal mixing vessel can be regulated by means of a heat exchanger in the slurry recycle line to cool the recycle slurry. However, this method is inefficient because it involves indirect heat transfer. In the present process, the temperature of the feed coal mixing vessel is regulated at least in part by direct heat transfer by a method involving control of the moisture content of the coal feed to the mixing vessel via regulation of the coal predrying step. According to the present method, if the temperature in the mixing vessel is too high, the amount of drying performed in the coal predrying zone can be reduced so that the moisture content of the coal in the mixing vessel is increased and the additional drying performed in the mixing vessel reduces the temperature therein. If necessary, the moisture content of the coal feed to the mixing vessel can be reduced in order to reduce water vaporization therein, thereby increasing the temperature in the feed mix vessel. Between about 0 or 5 and 90 weight percent, generally, and between about 30 and 70 weight percent, preferably, of the moisture content of the feed coal is removed in the predrying zone, with essentially all of the remaining moisture being removed in the mixing vessel. If undried coal is added to the mixing vessel maximum cooling and a minimum temperature will prevail and the temperature control feature made possible by partial predrying will not be achieved. The pressure in the mixing vessel is considerably below process pressure, and can be less than even about three inches of water. The pressure needs to be just sufficient to permit condensation heat recovery of vented water vapor and to permit scrubbing of entrained hydrocarbons or noxious gases, such as hydrogen sulfide, prior to leaving the process.

Slurry is removed from the mixing vessel independently of the vented vapor stream. The removed slurry is pumped to process pressure and passed to a preheater zone. The preheater zone commonly comprises a heated plug flow coil receiving heat indirectly from combustion of process fuel. However, in an independent inventive embodiment of the present process the preheater vessel is thoroughly backmixed and receives a part or all of its heat by intermixing of its contents with a hot process stream to increase the temperature to a level at which at least a portion of the coal dissolves.

The entire slurry from the preheater zone can be mixed with some or all of the process hydrogen and passed to the inlet of a dissolver zone wherein normally solid dissolved coal contained in the slurry is exothermically hydrocracked to normally liquid coal and hydrocarbon gases. However, in accordance with an independent inventive embodiment of the present process, a considerable process heat economy is achieved by admixing only a portion of the preheated slurry with only a portion of the process hydrogen, and then passing this partial admixture to the inlet of the dissolver zone. In this embodiment, less than half, more than half or essentially all of the external heat which is supplied to the process is used to preheat the portion of the process hydrogen supplied to this partial admixture. Although any amount of external heat can also be used for preheating of process slurry, if desired, essentially no external heat need be used for direct preheating of process slurry and essentially no external heat need be introduced elsewhere in the dissolver zone.

Since hydrogen has a low specific heat, a relatively small heat input will increase the temperature of the hydrogen to a relatively high level. When the preheated hydrogen is directly admixed with only a portion of the process slurry, the temperature of the admixture rapidly increases at least to the threshold temperature required for the onset of hydrocracking reactions. Since the hydrocracking reactions are exothermic, further process heat is then supplied autogenously within the dissolver zone and no additional external heat is required by the process. However, the principle of this inventive embodiment will still apply if some external heat is introduced elsewhere in the process, e.g. by pretreating some of the slurry flowing to the dissolver zone with the preheated hydrogen. The remainder of the process slurry and the remainder of the hydrogen can then be introduced downstream in the dissolver zone and will react under the influence of the autogenously generated heat.

It is seen that the admixture of a preheated portion of the process hydrogen stream with only a portion of the dissolver feed slurry provides a triggering effect for the onset of hydrocracking reactions. The rapid onset of hydrocracking reactions in the partial hydrogen-slurry admixture is important to the success of the triggering effect because the dissolver zone must also be capable of independently accepting the relatively low temperature remainder of the process hydrogen and feed slurry at a downstream region. In order to insure that the reactions in the dissolver proceed under these conditions it is important that mineral residue be recycled within the process and especially that the triggering reaction occurs in the presence of recycle mineral residue, since recycle mineral residue is a highly effective catalyst for the catalyzation of hydrocracking reactions.

The heat generated by the exothermic reactions which are triggered in the dissolver zone is sufficient to increase the temperature of the total mass of material in the dissolver including preheater effluent slurry and hydrogen added downstream in the dissolver to a level adequate to sustain hydrocracking for the total dissolver system. Therefore, the portion of the process hydrogen stream which is not preheated can be added to the dissolver zone in a downstream region thereof at a temperature below the average temperature prevailing in the dissolver zone. Similarly, the portion of the preheater effluent slurry which is not admixed with the preheated hydrogen can be added to the dissolver zone in a downstream region thereof at a temperature below the average temperature in the dissolver zone. Thereby, the reactant streams charged to the downstream region of the dissolver serve as quench streams, in addition to being reactant streams. It is seen that the addition of external heat to only a portion of the total hydrogen stream and the admixture of this preheated hydrogen stream with only a portion of the dissolver feed slurry which contains recycle mineral residue to catalyze hydrocracking reactions permits the addition of a minimal amount of external heat to a stream having a low specific heat to trigger sufficient exothermic hydrocracking reactions to in turn accomodate a substantial portion, most, or all of the remainder of the process heat requirement. If both inventive embodiments of the process are practiced together, little or no external heat need be added to the slurry in the preheater zone or to the slurry at any other process location beyond the heat added to the heat triggering portion of the hydrogen stream which is premixed with a portion of the dissolver slurry.

Between about 20 and 90 volume percent of the total hydrogen stream, generally, and between about 50 and 80 volume percent of the total hydrogen stream, preferably, can be used as the reaction triggering stream. The triggering hydrogen stream can be preheated to a temperature between about 700° and 1,200° F. (371° and 649° C.), generally, or to a temperature between about 800° and 1,000° F. (427° and 538° C.), preferably. Between about 30 and 90 weight percent of the preheater effluent slurry, generally, and between about 40 and 70 weight percent of the preheater effluent slurry, preferably, can be used as the triggering slurry stream. The remainder of the total hydrogen and of the preheater effluent slurry is passed to a downstream region of the dissolver zone. The remainder of the total hydrogen is introduced to the dissolver zone at a temperature between about 100° and 600° F. (38° and 316° C.), while the remainder of the preheater effluent is introduced to the dissolver zone at the temperature prevailing in the preheater zone. In order to provide an adequate catalytic effect for the triggering reaction, the dissolver effluent mineral residue-containing slurry is recycled. The weight ratio of 380° F.+ (193° C.+) recycle slurry to dry feed coal is between about 1.5 and 4.

The hot dissolver effluent stream is passed to a high temperature vapor-liquid separator zone wherein a high temperature separator vapor stream comprising hydrogen, hydrocarbon gases, naphtha and even some higher boiling normally liquid coal is separated from a high temperature separator residue stream comprising hot normally liquid coal and normally solid dissolved coal with suspended mineral residue. Both of these streams are hot and can be used for direct heat transfer to the process. The hot vapor stream is passed at essentially process pressure (to avoid the energy loss incident to a significant pressure reduction) to the backmixed preheater zone and directly admixed with the contents thereof to supply heat thereto. After thorough mixing within the preheater zone, a cool preheater vapor stream comprising hydrogen, hydrocarbon gases, naphtha and some higher boiling normally liquid coal is independently vented through a low temperature vapor-liquid separator and removed from the process. Venting from the process of a vapor stream obtained from the preheater zone independently of removal of a slurry stream from the preheater zone is essential to the recovery of heat by direct heat exchange from the hot dissolver zone vapor. The venting of vapor from the preheating zone independently of slurry removal is made feasible because makeup and/or recycle hydrogen is added to the process downstream from the preheating zone.

There is a condensation and accumulation within the system of liquid boiling in the temperature range defined by the temperature of the high temperature separator on the high side and the temperature of the preheater zone on the low side at the pressure of the system. This accumulated liquid provides an advantageous effect because it lowers the viscosity of process slurry, enhances heat transfer and enhances the availability within the system of valuable hydrogen donor solvent.

The pressure of the hot slurry from the high temperature dissolver vapor-liquid separator can be reduced without significant heat loss because the slurry is essentially free of gaseous materials. Therefore, the hot slurry is reduced in pressure and passed to the feed coal mixing vessel for direct admixture with the contents thereof to supply heat thereto and to complete the drying of the feed coal. In this manner, heat from both the hot vapor stream and the hot liquid stream obtained from the dissolver vapor-liquid separator means is recovered by direct heat exchange within the process. Therefore, when both inventive embodiments of the process are practiced together, a magnification or pyramiding of the heat economy arising from the aforementioned hydrocracking triggering effect is achieved by transferring a first portion of the exothermically generated heat to the preheater zone and by transferring a second portion of the exothermically generated heat to the feed coal mixing vessel.

The preheater temperature should be maintained at a level which is sufficiently high so that the viscosity of the process slurry will rapidly peak and then decline. The decline occurring after the viscosity peaks results from depolymerization reactions in the gel formed between the feed coal and process solvent as the gel goes into solution. The temperature of depolymerization varies, but is generally in the range 500° to 750° F. (260° to 399° C.), or 600° to 700° F. (316° to 371° C.).

In the dissolver zone, the heat generated by the exothermic reactions raises the average temperature of the reactants to the range 800° to 900° F. (427° to 482° C.), preferably 840° to 870° F. (339° to 466° C.). The residence time of the slurry in the dissolver zone is longer than in the preheater zone. The average residence time of the slurry in the preheater zone is between about 0.02 and 0.5 hours, while the average residence time in the dissolver zone is longer and is between 0.3 and 2 hours. Because of the exothermic reactions occurring therein, the average dissolver temperature is at least 20°, 50°, 100° or even 200° F. (11.1°, 27.8°, 55.5° or even 111.1° C.) higher than the temperature of the preheater. The hydrogen pressure in the preheating and dissolver zones is in the range 1,000 to 4,000 psi, and is preferably 1,500 to 2,500 psi (70 to 280, and is preferably 105 to 174 kg/cm$^2$).

The inventive embodiments of the present process are illustrated in the attached drawing. As shown in the drawing, undried particulate feed coal containing between about 3 and 40 weight percent water passes through line 10 to coal drying zone 12 to which heat is added through line 14 to remove between about 30 and 70 weight percent of the water content of the feed coal. Water vapor is discharged through line 16.

Partially dried coal is passed through line 18 to mixing vessel 20 in which the coal is slurried in a recycle slurry entering through line 22. The recycle slurry in line 22 comprises solvent liquid boiling in the range of about 380° to 850° F. (193° to 454° C.), normally solid dissolved coal boiling above 850° F. (454° C.) and suspended mineral residue containing undissolved organic matter. Mixing vessel 20 is at a temperature in the range 300° to 500° F. (149° to 260° C.), typically 450° F. (232° C.), and at a pressure below process pressure, i.e. below about 100 psi (7 kg/cm$^2$), typically near atmospheric pressure, i.e. about 1 inch (2.54 cm) of water. Because vessel 20 is vented through line 24 the recycle stream in line 22 must be essentially free of hydrocarbons boiling at or lower than the temperature in vessel 20. Recycle stream 22 is at a pressure near atmospheric and is at a temperature of about 825° F. (441° C.). The quantity of sensible heat added to mixing vessel 20 via the slurry in line 22 is adequate to accomplish essentially complete drying of the feed coal. Water vapor formed in vessel 20 and vented through line 24 passes through condensor drum 26, from which any entrained hydrocarbon gases are recovered through line 28 and from which heat can be recovered by heating boiler feed water passing through line 30, forming condensate which is recovered through line 32.

The slurry in vessel 20 is thoroughly backmixed by means of a circulation system comprising effluent line 34, circulating pump 36 and recycle line 38. A mixing vessel effluent slurry is passed through line 40 and is then pumped to a process pressure of about 2,000 psi (140 kg/cm$^2$) by means of reciprocating pump 42 and then passed through line 44 to preheat vessel 46. The slurry remains in vessel 46 for a residence time of about 0.1 to 0.2 hours wherein it is preheated to a temperature between 600° and 700° F. (316° and 371° C.), typically about 640° F. (338° C.). Preheat vessel 46 is thoroughly backmixed by means of a circulation system comprising effluent line 48, circulating pump 50 and recycle line 52.

Preheater effluent slurry is passed through line 54 and the total stream is divided so that between about 40 and 70 weight percent thereof is passed through line 56 to an upstream region in dissolver vessel 58, while the remainder of the slurry comprising between about 30 and 60 weight percent thereof is passed to a downstream region in dissolver vessel 58 through line 60. Process hydrogen which comprises primarily purified recycle hydrogen, together with a minor amount of make-up hydrogen, is introduced through line 62. Between about 50 and 80 volume percent of the total hydrogen stream is designated for use as a heat trigger for the process and is passed through line 64 to hydrogen preheat coil 66 within hydrogen preheat furnace 68. If desired, essentially all external heat utilized in the liquefaction zone can be obtained by means of fuel combustion in hydrogen furnace 68 so that the portion of the hydrogen feed passing through line 64 and coil 66 can constitute the only process stream receiving heat directly from a source outside of the process.

The heated hydrogen leaving preheat furnace 68 is at a temperature between about 800° and 1,000° F. (427° and 538° C.) and passes through line 70 for admixture with the portion of the preheater effluent slurry passing through line 56. The hydrogen-slurry mixture flows through line 72 of the upstream region of dissolver vessel 58. The amount of sensible heat contained in the hydrogen stream in line 70 is adequate in the presence of catalytic recycled mineral residue to increase the temperature of the slurry segment in line 56 to the hydrocracking range so that the temperature at the bottom of dissolver 58 can increase autogenously by means of exothermic hydrogenation and hydrocracking reactions. The temperature in dissolver 58 would continue to rise above the desired dissolver temperature of about 840° to 870° F. (449° to 466° C.) without quenching. To accomplish quenching, the remaining segment of the preheater slurry in line 60 is introduced to dissolver 58 at a downstream region thereof, while the non-preheated portion of the hydrogen stream by-passes furnace 68 through line 74 for introduction in a cool condition to dissolver 58 at several locations in a downstream region thereof. The quenching effect of the streams in lines 60 and 74 serves to maintain a uniform hydrocracking temperature in the range 840° to 870° F. (449° and 466° C.), and typically about 850° F. (454° C.) in dissolver 58.

After a residence time of about 0.5 to 2 hours in dissolver 58 to allow the desired time dependent hydrocracking reactions occur, a dissolver effluent stream is removed through line 76 and is passed to high temperature separator 78. High temperature separator 78 is maintained at a temperature of about 700° to 850° F. (371° to 454° C.), typically about 825° F. (441° C.), and a vapor stream comprising hydrogen, hydrocarbon gases, $C_5$ to 380° F. (193° C.) naphtha and a small amount of higher boiling dissolved liquid coal is removed overhead through line 80 while a bottoms slurry stream comprising most of the 380° to 850° F. (193° to 454° C.) normally liquid coal, all of the 850° F.+ (454° C.+) normally solid dissolved coal and suspended mineral residue is removed independently through line 82. A portion of the slurry in line 82 passes through line 84 to a product recovery system which will normally include atmospheric and vacuum distillation means and a partial oxidation gasifier to produce hydrogen for the process and possibly also produce syngas for use as fuel in hydrogen furnace 68. The remainder of the slurry comprising between about 50 and 90 weight percent of the total passes through line 22 for recycle to mixing vessel 20 in order to supply recycle liquid coal solvent for the process, recycle mineral residue to serve as a catalyst for hydrogenation and hydrocracking reactions and normally solid dissolved coal which will experience hydrocracking and conversion to liquid coal.

The vapor removed from high temperature separator 78 passes through line 80 and is maintained at process pressure to avoid heat loss which would otherwise occur during a pressure let-down in a gaseous system. This hot vapor is introduced into preheat vessel 46 in which it is well mixed to accomplish direct transfer of its sensible heat to the slurry within preheat vessel 46, thereby increasing the temperature in the preheat vessel to the range 600° to 700° F. (316° to 371° C.), typically about 640° F. (338° C.). The cooled vapor in preheat vessel 46 is continously vented through overhead line 86. The vented vapor passes through heat exchanger 88 and heat is recovered therefrom by means of boiler feed water passing through line 90. Cooled vented vapor is then passed to low temperature separator 92. Low temperature separator 92 is maintained at a temperature in the range of about 400° to 500° F. (204° and 260° C.), typically about 450° F. (232° C.). A vapor stream containing hydrogen for purification and recycle is recovered from separator 92 through line 94, leaving a liquid product stream which is recovered through line 96.

In the described process hot vapors from dissolver 58 at high pressure are vented through preheat vessel 46 to accomplish heat recovery by direct heat exchange. Since this operation requires the preheat zone to be continously vented so that vapors can be removed therefrom independently of effluent slurry, the operation is only feasible because no hydrogen is added to the preheater stage of the process. Furthermore, the hydrogen stream which is introduced to dissolver 58 is divided and a portion thereof is heated to enable it to serve as a heat trigger to initiate hydrogenation and hydrocracking reactions in a segment of the dissolver feed slurry. After the hydrogenation and hydrocracking reactions are initiated, the process generates its own heat via exothermic reactions. The high interdependence between the processing steps is readily apparent because it is the introduction of the hydrogen stream to the process after the preheat step which permits the triggering heat economy effect to be accomplished, and the fact that hydrogen is not introduced to the preheat step allows the hot dissolver vapors to be vented through the preheater zone to permit recovery of exothermic process heat by direct heat transfer, thereby pyramiding the heat economy effect realized by the hydrogen heat trigger.

Because vapors from high temperature separator zone 78 at a temperature of 825° F. (441° C.) are quenched in preheater zone 46 at a temperature of 640° F. (338° C.), there is a condensation and accumulation within preheater 46 of liquid which boils in the range 640° to 825° F. (338° to 441° C.) at the pressure of the system. The accumulated liquid circulates through preheater zone 46, dissolver zone 58 and separator zone 78. An advantageous effect realized because of the accumulated liquid is the moderation of pumping problems due to gel formation. In addition, the accumulated liquid enhances internal direct heat transfer within the system. Finally, the accumulated liquid enhances the availability within the system of valuable hydrogen donor solvent.

We claim:

1. A coal liquefaction process comprising passing wet feed coal to a coal predrying zone to remove a portion of the moisture content thereof; passing partially dried feed coal from said predrying zone together with recycle slurry comprising normally solid dissolved coal, liquid coal and mineral residue to a backmixed feed slurry mixing vessel operated at a pressure below process pressure; venting vapor from said feed slurry mixing vessel independently of removal of mixing vessel effluent slurry to release water vapor formed thereon; pressurizing to process pressure mixing vessel effluent slurry and passing said mixing vessel effluent slurry to a preheater vessel to increase the temperature thereof to a level at which at least a portion of the coal dissolves; passing preheater vessel effluent slurry together with hydrogen to a dissolver zone to exothermically hydrocrack normally solid dissolved coal to liquid coal and hydrocarbon gases; passing hot dissolver zone effluent slurry through high temperature vapor-liquid separator means to remove an overhead vapor stream comprising hydrogen, hydrocarbon gases and naphtha from a separator slurry comprising liquid coal and normally solid dissolved coal with suspended mineral residue; recycling a portion of said separator slurry to said mixing vessel; passing said overhead vapor stream at process pressure to said preheater vessel for direct admixture with the slurry therein to quench said overhead vapor stream and heat the slurry therein; and venting vapor from said preheater vessel independently of removal of effluent slurry from said preheater vessel.

2. The process of claim 1 wherein between about 5 and 90 weight percent of the moisture content of the feed coal is removed in said predrying zone.

3. The process of claim 1 wherein the temperature of said recycled separator slurry is above the temperature in said mixing vessel; and said recycled separator slurry adds heat to the mixing vessel to dry the coal therein.

4. The process of claim 1 wherein the temperature of the slurry in said feed slurry mixing vessel is between about 300° and 500° F. and the residence time of the slurry in said feed slurry mixing vessel is between about 5 and 30 minutes.

5. The process of claim 1 when said quench of said overhead vapor stream in said preheater vessel induces condensation in said preheater vessel and accumulation in said process of hydrogen donor solvent liquid.

* * * * *